United States Patent [19]

Nyholm

[11] 4,168,754

[45] Sep. 25, 1979

[54] IMPACT TOOL

[76] Inventor: Bengt V. Nyholm, 43 Atlasvägen, 13100 Nacka, Sweden

[21] Appl. No.: 791,053

[22] Filed: Apr. 26, 1977

[30] Foreign Application Priority Data

May 7, 1976 [SE] Sweden ..... 7605218

[51] Int. Cl.[2] ..... B25D 17/12

[52] U.S. Cl. ..... 175/325; 29/447; 173/162 R; 173/DIG. 2; 181/207

[58] Field of Search ..... 181/207; 175/320, 325; 173/162, DIG. 2; 29/447

[56] References Cited

U.S. PATENT DOCUMENTS

| | | | |
|---|---|---|---|
| 3,297,819 | 1/1967 | Wetmore | 29/447 |
| 3,842,942 | 10/1974 | Jensen et al. | 173/DIG. 2 |
| 3,848,931 | 11/1974 | Swisher | 173/DIG. 2 |
| 3,861,494 | 1/1975 | Grego | 173/DIG. 2 |
| 3,918,530 | 11/1975 | Nyholm | 173/DIG. 2 |
| 4,044,625 | 8/1977 | D'Haem et al. | 173/162 |

*Primary Examiner*—William Pate, III

*Attorney, Agent, or Firm*—Flynn & Frishauf

[57] ABSTRACT

A vibration damper for an impact tool comprises a damping material which at least partly surrounds the working part of the tool, a heat shrinkable sleeve for holding the damping material in place on the working part of the tool.

19 Claims, 7 Drawing Figures

IMPACT TOOL

The present invention relates to impact tools comprising a vibration damper for damping lateral vibrations of a working part of the tool. Examples of such tools are breakers for breaking up concrete pavements and the like, spades and chisels of different kinds and drill rods for rock drilling.

A tool of the above mentioned kind is designed to transfer considerable impact energies in its longitudinal direction from an impact machine, to which the tool is connected, to the material being worked. In order to damp the emission of sound from the tool, caused by vibrations in the tool, one has earlier used sleeves of rubber or plastic held in place by metal clamps or channels in the tool filled with damping material e.g. certain metal alloys or sand.

SUMMARY OF THE INVENTION

According to the present invention the vibration damper comprises a vibration damping material which at least partly surrounds the working part of the tool, preferably along a shorter part of its length. The vibration damping material is held in place by a heat shrinkable sleeve which surrounds the working part of the tool and the vibration damping material. The heat shrinkable sleeve, at a certain elevated temperature, decreases considerably in diameter.

According to an advantageous embodiment of the invention the vibration damping material comprises a liquid-like material which is enclosed in a bag. The bag is advantageously divided into several sections in order to secure an even distribution of the liquid-like material. Liquid-like material refers to a liquid with or without admixtures. A liquid is hereby defined as a body having an indefinite form but a definite volume. As examples of suitable liquid-like materials one could mention unvulcanized silicon rubber, silicon grease, oils and other liquids containing dispersed or dissolved polymeric material or dispersed solid material e.g. iron powder. By means of the present invention an impact tool with an efficient and easily mounted vibration damper is obtained.

BRIEF DESCRIPTION OF THE DRAWINGS

Some embodiments of the invention will be described below with reference to the accompanying drawings in which.

DETAILED DESCRIPTION

Figure 1:
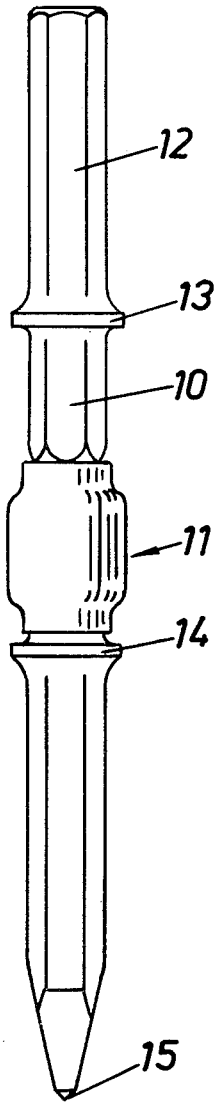
FIG. 1 shows an impact tool according to the invention.
Figure 2:
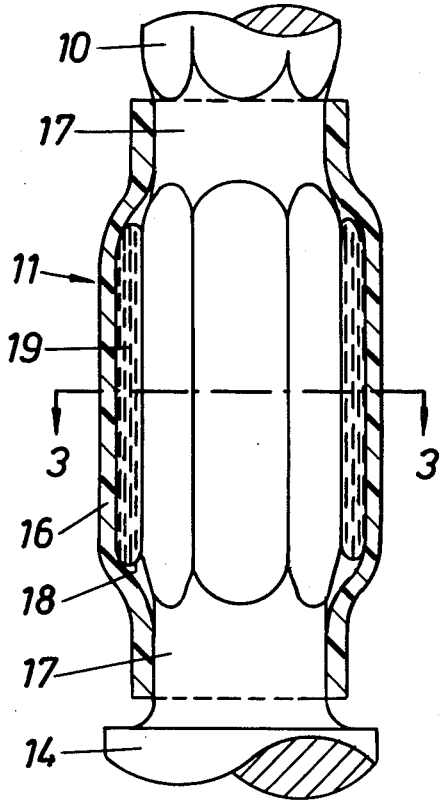
FIG. 2 shows on a larger scale and partly in section a part of the tool according to FIG. 1.
Figure 3:
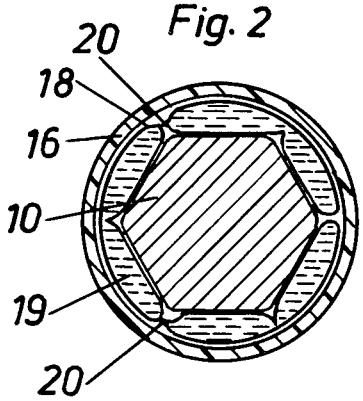
FIG. 3 shows a section according to 3—3 in FIG. 2.

The impact tool shown in FIGS. 1-3 comprises a working part 10 which is provided with a working end 15 and a shank 12 meant to be put into a not shown impact machine. The tool is provided with a usual collar 13, a vibration damper 11 and a protection collar 14 situated in front of the damper. The protection collar can be omitted on tools which are not meant for penetration into the material being worked.

As shown in FIGS. 2 and 3 the vibration damper, in this embodiment, comprises a bag 18 filled with a vibration damping material 19 and surrounding the working part 10. The bag 18 is held in place by means of a heat shrinkable sleeve 16 which has been shrunk on. The heat shrinkable sleeve has before the mounting been prepared internally with glue. This glue has been chosen such that it becomes adhesive at the shrinking temperature of the heat shrinkable sleeve. Through this a bond between the heat shrinkable sleeve and the cylindrical parts 17 on the working part 10 of the tool is obtained when the sleeve is shrunk on. In order to secure an even distribution of the liquid-like material the bag 18 is divided into three sections by means of longitudinal welds 20. To mount the vibration damper, the bag 18 is placed around the working part 10 after which a heat shrinkable sleeve 16 prepared with glue is slipped on. The assembly is then heated to the shrinking temperature of the heat shrinkable sleeve which then shrinks. In this way the vibration damper is easily and safely mounted on the working part 10 of the tool because of the stresses which arise at the shrinking and because of the glue bonds.

Figure 4:
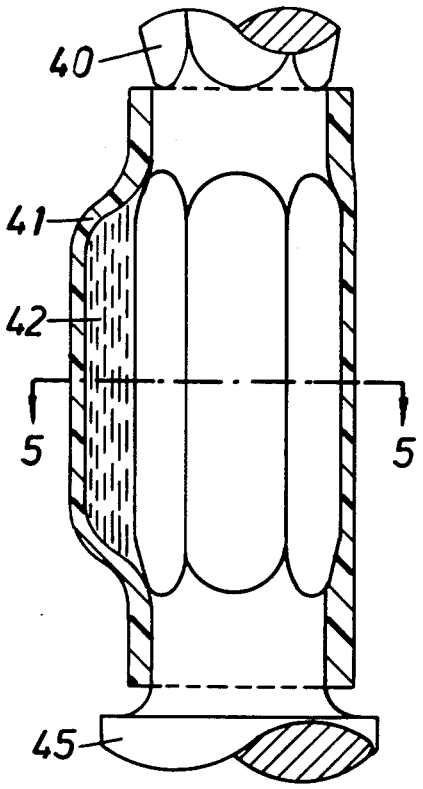
FIG. 4 shows a second embodiment of the invention.
Figure 5:
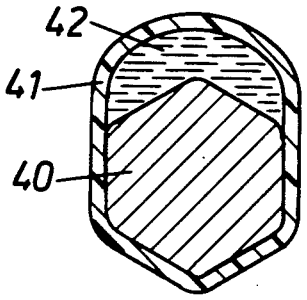
FIG. 5 shows a section according to 5—5 in FIG. 4.

The embodiment according to FIGS. 4 and 5 differs from the above described in that the vibration damper is eccentric relative to the longitudinal axis of the tool. The working part 40 of the tool is surrounded by a heat shrinkable sleeve 41 which also surrounds a liquid-like material 42. In this embodiment the liquid-like material only partly surrounds the working part 40. The liquid-like material can also in this embodiment advantageously be enclosed in a plastic bag. Since the vibration damping material only partly surrounds the working part 40 a substantially stronger glue bond is obtained when the heat shrinkable sleeve 41 prepared with glue is shrunk while on the working part 40. Tools with eccentrically arranged vibration dampers are particularly suitable when one of the sides of the tool will glide along still unworked material during the penetration of the material. In order to protect the vibration damper, the working part 40 is provided with a protection collar 45.

Figure 6:
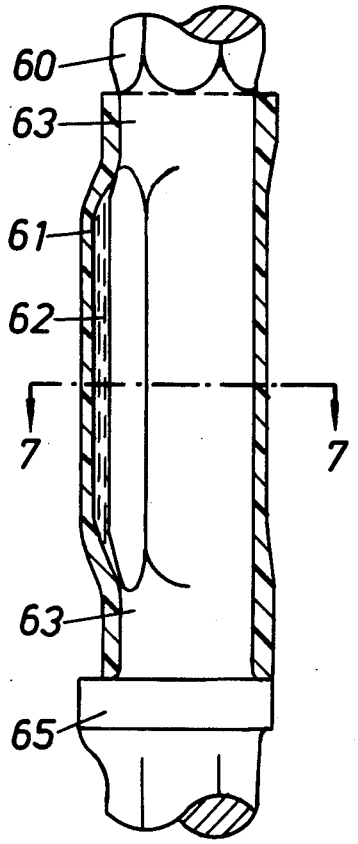
FIG. 6 shows a third embodiment of the invention.
Figure 7:
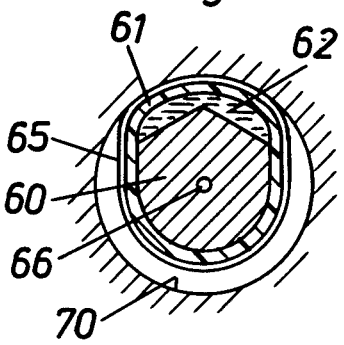
FIG. 7 shows a section according to 7—7 in FIG. 6.

FIGS. 6 and 7 show a drill rod for rock drilling provided with an eccentric vibration/damper similar to the one shown in FIGS. 4 and 5. The working part 60 is surrounded by a heat shrinkable sleeve 61 which also surrounds a liquid-like material 62. The liquid-like material only partly surrounds the working part 60. The working part is furthermore provided with a protection collar 65 which is eccentric relative to the longitudinal axis of the tool and a channel 66 for supplying flushing fluid, gas or liquid, to the bottom of the drill-hole for flushing away drill cuttings therefrom. Since the vibration damper is eccentrically arranged, a slot is obtained between the wall 70 of the drill-hole and the tool. The drill cuttings are removed through this slot.

The described and illustrated embodiments of the invention are only to be regarded as examples which can be modified within the scope of the subsequent claims.

What I claim is:

1. An impact tool comprising a working part (10) and a vibration damper (11), the improvement wherein the vibration damper (11) comprises:

a flowable vibration damping material (19;42;62) which at least partly surrounds the working part of the tool; and an envelope (16) which surrounds the working part (10) of the tool and the flowable vibration damping material, the envelope being in contact with the working part to hold the flowable vibration damping material in place, the envelope comprising a heat shrinkable sleeve which is shrinkable upon application of heat thereto and which is caused to shrink around the working part of the tool and around the flowable vibration damping material by application of heat to the heat shrinkable sleeve while it is surrounding the working part of the tool and the flowable vibration damping material.

2. An impact tool according to claim 1, wherein the vibration damping material (42) is eccentrically arranged relative to the longitudinal axis of the tool.

3. An impact tool according to claim 1, wherein the heat shrinkable sleeve (16) is fastened to the working part (10) of the tool by means of an adhesive which is pre-applied to the heat shrinkable sleeve, which adhesive adheres at the skrinking temperature of the heat shrinkable sleeve.

4. An impact tool according to claim 1, wherein the tool comprises a protection collar (14;65) situated forward of the vibration damper (11).

5. An impact tool according to claim 4, wherein the protection collar (65) is eccentric relative to the longitudinal axis of the tool.

6. An impact tool according to claim 1, wherein the vibration damping material is a liquid-like material.

7. An impact tool according to claim 6, wherein the liquid-like material (19) is enclosed in a bag (18).

8. An impact tool according to claim 7, wherein the bag (18) is divided into sections in order to secure an even distribution of the liquid-like material (19).

9. An impact tool according to claim 1, wherein the vibration damper (11) extends along a minor part of the length of the working part (10).

10. An impact tool according to claim 2, wherein the heat shrinkable sleeve (16) is fastened to the working part (10) of the tool by means of an adhesive which is pre-applied to the heat shrinkable sleeve, which adhesive adheres at the shrinking temperature of the heat shrinkable sleeve.

11. An impact tool according to claim 8, wherein the sections are arranged around the periphery of the tool and extend in the longitudinal direction of the tool.

12. An impact tool according to claim 1, wherein the heat shrinkable sleeve contacts the working part (10) of the tool at least both above and below, in the longitudinal direction of the tool, the vibration damping material.

13. An impact tool according to claim 12, wherein the heat shrinkable sleeve (16) is fastened to the working part (10) of the tool by means of an adhesive which is pre-applied to the heat shrinkable sleeve, which adhesive adheres at the shrinking temperature of the heat shrinkable sleeve.

14. An impact tool according to claim 6, wherein the heat shrinkable sleeve contacts, in a liquid tight manner, the working part (10) of the tool at least both above and below, in the longitudinal direction of the tool, the vibration damping material to contain the liquid-like material between the contact areas of the sleeve with the working part of the tool.

15. An impact tool according to claim 14, wherein the heat shrinkable sleeve (16) is fastened to the working part (10) of the tool by means of an adhesive which is pre-applied to the heat shrinkable sleeve, which adhesive adheres at the shrinking temperature of the heat shrinkable sleeve.

16. An impact tool comprising a working part (10) and a vibration damper (11), the improvement wherein the vibration damper (11) comprises:

a liquid-like vibration damping material (19;42;62) which at least partly surrounds the working part (10) of the tool; and an envelope (16) which surrounds the working part (10) of the tool and the vibration damping material to contain the vibration damping material, the envelope comprising a heat shrinkable sleeve which is shrinkable upon application of heat thereto and which is caused to shrink around the working part of the tool and around the vibration damping material by application of heat to the heat shrinkable sleeve while it is surrounding the working part of the tool and the vibration damping material.

17. An impact tool comprising a working part (10) and a vibration damper (11), the improvement wherein the vibration damper (11) comprises:

a liquid-like vibration damping material (19) which at least partly surrounds the working part (10) of the tool;

a bag (18) in which the liquid-like vibration damping material (19) is enclosed; and an envelope (16) which surrounds the working part (10) of the tool and the bag containing the vibration damping material, the envelope comprising a heat shrinkable sleeve which is shrinkable upon application of heat thereto and which is caused to shrink around the working part of the tool and around the bag and the vibration damping material by application of heat to the heat shrinkable sleeve while it is surrounding the working part of the tool and the vibration damping material.

18. An impact tool according to claim 17, wherein the bag (18) is divided into sections in order to secure an even distribution of the liquid-like material (19).

19. An impact tool according to claim 18, wherein the sections are arranged around the periphery of the tool and extend in the longitudinal direction of the tool.

* * * * *